US005615240A

United States Patent [19]

Wolters, Jr. et al.

[11] Patent Number: 5,615,240

[45] Date of Patent: Mar. 25, 1997

[54] NUCLEAR FUEL BUNDLE PACKAGING APPARATUS

[75] Inventors: Richard A. Wolters, Jr.; James E. Boyden, both of San Jose; Donald K. George, Los Gatos; Donald K. Henrie, Morgan Hill; Robert H. Jones, Los Gatos; Michael G. McBride, San Jose, all of Calif.

[73] Assignee: General Electric Company, Schenectady, N.Y.

[21] Appl. No.: 330,824

[22] Filed: Oct. 27, 1994

[51] Int. Cl.[6] ..... G21F 5/008

[52] U.S. Cl. ..... 376/272

[58] Field of Search ..... 376/272, 261, 376/260, 446; 250/507.1, 506.1

[56] References Cited

U.S. PATENT DOCUMENTS

| | | | |
|---|---|---|---|
| 4,680,159 | 7/1987 | Lahr et al. | 376/272 |
| 4,781,883 | 11/1988 | Daugherty et al. | 376/272 |
| 4,800,283 | 1/1989 | Efferding | 376/272 |
| 5,353,317 | 10/1994 | Barkhurst | 376/272 |
| 5,438,597 | 8/1995 | Lehnert et al. | 376/272 |

*Primary Examiner*—Daniel D. Wasil

*Attorney, Agent, or Firm*—Nixon & Vanderhye P.C.

[57] ABSTRACT

In a nuclear reactor fuel bundle packaging apparatus including a hollow cylindrical cask (22) and a basket liner assembly (23) receivable within the cask, the basket liner assembly including a plurality of laterally spaced disks (26) rigidly held by a plurality of tie rods (28), and a plurality of elongated hollow basket liners (33) extending through and fixed to the plurality of disks, each hollow basket liner (33) holding a nuclear fuel bundle assembly (10) having an upper tie plate (14), a lower tie plate (16) and a plurality of fuel rods (12) arranged in a substantially square array, extending between the upper and lower tie plates, the improvement comprising an oversized hollow fuel bundle channel (68) received over the fuel bundle assembly, the channel (68) having the same cross sectional shape as the basket liner (33) but sized to fit within the basket liner, the basket liner having at least one slot (74) formed in at least one side thereof at each disk, and at least one spring (72) mounted on the basket liner (33) spanning the slot (74) with one surface of the spring engaging the disk (26) and another surface of the spring engaging an adjacent surface of the oversized hollow fuel bundle channel (68).

21 Claims, 8 Drawing Sheets

FIG. 11
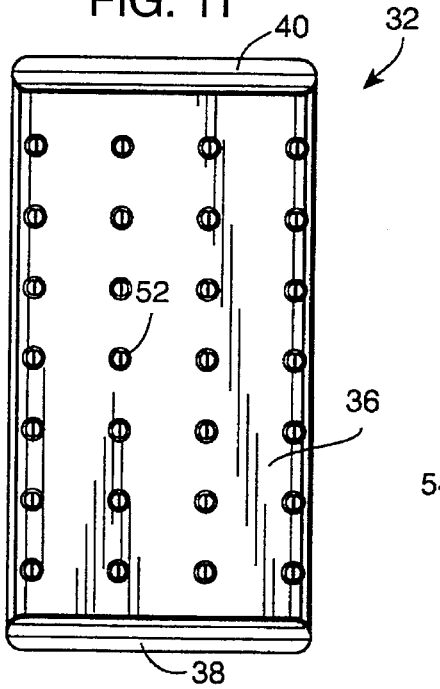
FIG. 12
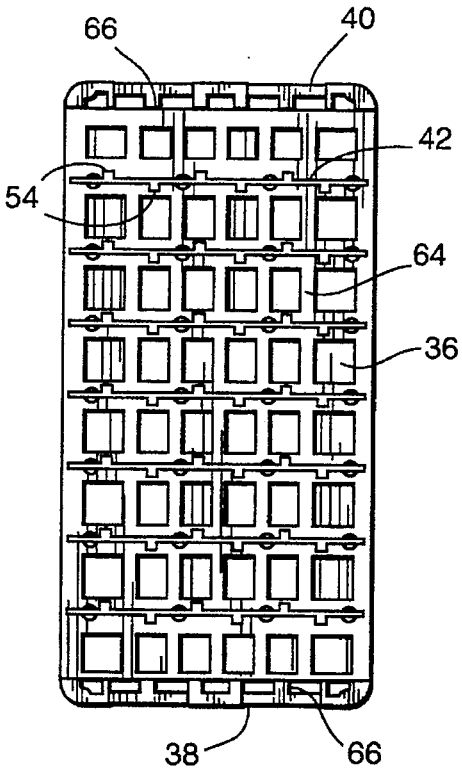
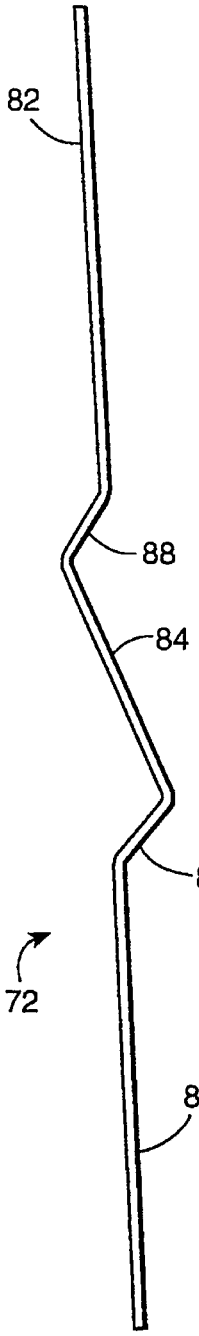
FIG. 17
FIG. 16
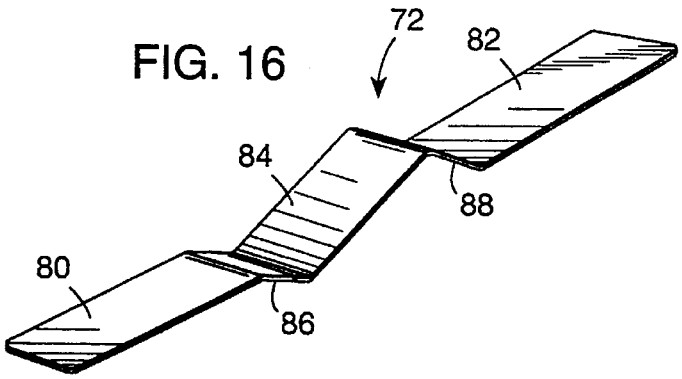

NUCLEAR FUEL BUNDLE PACKAGING APPARATUS

TECHNICAL FIELD

This invention relates generally to the field of nuclear reactors and, specifically, to the safe shipment of new or used fuel bundles employed in such reactors.

BACKGROUND

Nuclear fuel bundle assemblies are highly engineered and costly manufactured products. While they are rugged in use, they must be protected from damage during shipping not only after initial manufacture, but particularly after use.

There is a conventional shipping container or cask assembly used specifically for the shipment of nuclear reactor fuel bundles. This container or cask assembly essentially comprises a cylinder closed at one end in combination with a "basket liner assembly" slidably receivable within the cask. This basket liner assembly is formed by a plurality of horizontally spaced disks held together by tie rods extending between the first and last of such disks. Each disk is also provided with, for example, seventeen square openings arranged in a uniform array and aligned with similar openings in the adjacent disks. Each set of aligned openings receives an elongated hollow tube, also known as a "basket liner". The basket liner has a substantially square cross sectional shape corresponding generally to (but larger than) the cross-sectional shape of the fuel bundle assemblies, and is welded in place at the various disks. New unchanneled fuel bundles, or used channeled fuel bundles are receivable within the various basket liners. After the bundles are installed in the basket liners, the open end of the cask is sealed shut and the cask is ready for shipping.

DISCLOSURE OF THE INVENTION

It is the principal purpose of this invention to provide an improved packaging system that can be remotely installed and removed, and that will better protect nuclear fuel bundle assemblies from damaging shocks and vibration during shipping.

The packaging system in accordance with this invention adds five additional components to the conventional cask assembly as described above. A first of the new components is referred to herein as a "clustered fuel rod separator unit" (or simply as a "separator unit"). For a typical fuel bundle assembly, sixty-four (64) such separator units will be utilized. Each separator unit comprises three basic parts. First, there is a substantially U-shaped holder which fits around one haft of the substantially square cross section of the fuel bundle. This holder captures a number of substantially parallel planar leaf elements (the second part) which extend from the base of the holder and substantially parallel to the sides thereof. A third part comprises one or more leaf elements specially designed to allow for the shape and size of water rods which may be used in the fuel bundle assembly. In use, one separator unit is inserted into the bundle such that the planar leaf elements extend between the rows of the bundle. These leaf elements increase the rigidity of the fuel bundle by allowing each fuel rod to support any other fuel rods surrounding it. Another cluster separator unit of the same design is inserted into the remaining half of the cross section of the bundle so that two such separator units provide full support through the array of a selected axial location along the bundle length. An adjacent pair of separator units are inserted into the bundle but rotated 90° to the first pair so that the fuel rods are supported both horizontally and vertically. This alternating arrangement of separator unit pairs is repeated along the length of the bundle, with four pairs of separator units installed between the conventional fuel rod spacer elements (typically, seven such spacers are used in a typical bundle).

The separator units in accordance with this invention have been provided with specially shaped notches to facilitate insertion and removal with an automated machine, and these operations can be carried out under water if required.

A second of the five new components in accordance with the invention is an oversized protective channel. With the separator units described above inserted within the bundle, the standard fuel bundle channel is unable to fit over the bundle. The oversized protective channel in accordance with this invention is sized to be slidably received over the bundle and to hold the separator units in place. This oversized channel provides additional rigidity and protection to the fuel bundle. If installed over used irradiated fuel, the oversized protective channel is designed to replace the existing channel and to use similar hardware to fit the existing upper and lower tie plates. If installed over new fuel, which is typically shipped separately from its channel (in a channel-like shipping container), the separate shipping container can be eliminated.

A third component of the packaging system in accordance with this invention comprises a flat leaf spring, a plurality of which are used to hold the (oversized) channeled fuel bundles within the basket liners in a resiliently biased fashion.

A fourth component of the packaging system is a specially designed bottom spring used at the bottom of the basket liner to cushion the fuel bundle assembly, and to minimize undesirable accelerations and loads on the bundle during shipping, or when the shipping container is raised to an upright position.

A fifth packaging component relates to polyethylene spacers utilized to occupy excess space between a spacer plate in the top of the shipping container or cask and the top of the fuel bundle within the cask. In the exemplary embodiment, spacer pads secured to the spacer plate of the cask at locations aligned with each basket liner, are covered with polyethylene sheets to prevent metal-to-metal contact between upper tie plate handles (which protrude beyond the individual basket liners) and the end plate pads. This also serves to reduce the axial space or play between the individual bundles and the cask ends. This is done to minimize the distance the fuel bundle can slide or drop during handling or shipping which, in turn, minimizes undesirable accelerations and loads on the fuel bundle assembly.

Accordingly, in one aspect, the present invention relates to a nuclear reactor fuel bundle packaging apparatus including a hollow cylindrical cask and a basket liner assembly receivable within the cask, the basket liner assembly including a plurality of laterally spaced disks rigidly held by a plurality of tie rods, and a plurality of elongated hollow basket liners extending through and fixed to the plurality of disks, each hollow basket liner holding a nuclear fuel bundle assembly having an upper tie plate, a lower tie plate and a plurality of fuel rods arranged in a substantially square array, extending between said upper and lower tie plates, the improvement comprising an oversized hollow fuel bundle channel received over the fuel bundle assembly, the channel having the same cross sectional shape as the basket liner member but sized to fit within the basket liner member, the basket liner having at least one slot formed in at least one side thereof at each disk, and a spring mounted on the basket liner spanning the slot with one surface of the spring engaging the disk and another surface of the spring engaging an adjacent surface of the oversized protective channel.

In another aspect, the invention relates to a nuclear reactor fuel bundle packaging apparatus including a hollow cylindrical cask and a basket liner assembly receivable within the cask, the basket liner assembly including a plurality of laterally spaced disks rigidly held by a plurality of tie rods, and a plurality of elongated hollow basket liners extending through and fixed to the plurality of disks, each hollow basket liner holding a nuclear fuel bundle assembly having an upper tie plate, a lower tie plate and a plurality of fuel rods arranged in a substantially square array, extending between the upper and lower tie plates, the improvement comprising first means for keeping the fuel rods in the array separated from each other; second means for resiliently laterally biasing the fuel bundle within the basket liner; third and fourth means for preventing substantial axial movement of the fuel bundle within the basket liner, the third and fourth means located at opposite ends, respectively, of the basket liner member.

In still another aspect, the invention relates to a nuclear reactor fuel bundle packaging apparatus including a hollow cylindrical cask and a basket liner assembly receivable within the cask, the basket liner assembly including a plurality of laterally spaced disks rigidly held by a plurality of tie rods, and a plurality of elongated hollow basket liners extending through and fixed to the plurality of disks, each hollow basket liner holding a nuclear fuel bundle assembly having an upper tie plate, a lower tie plate and a plurality of fuel rods arranged in a substantially square array, extending between the upper and lower tie plates, the improvement comprising means for resiliently holding the fuel bundle assembly within the basket liner, the means capable of exerting resilient biasing forces on the fuel bundle assembly in at least two mutually perpendicular directions.

Additional objects and advantages of the subject invention will become apparent from the detailed description which follows.

BRIEF DESCRIPTION OF THE DRAWINGS

FIG. 11 is a bottom plan of FIG. 6;

FIG. 12 is a top plan of FIG. 6;

FIG. 16 is a perspective view of a leaf spring for use in the packaging system of this invention;

FIG. 17 is an upright edge view of the spring shown in FIG. 16;

BEST MODE FOR CARRYING OUT THE INVENTION

Figure 1:
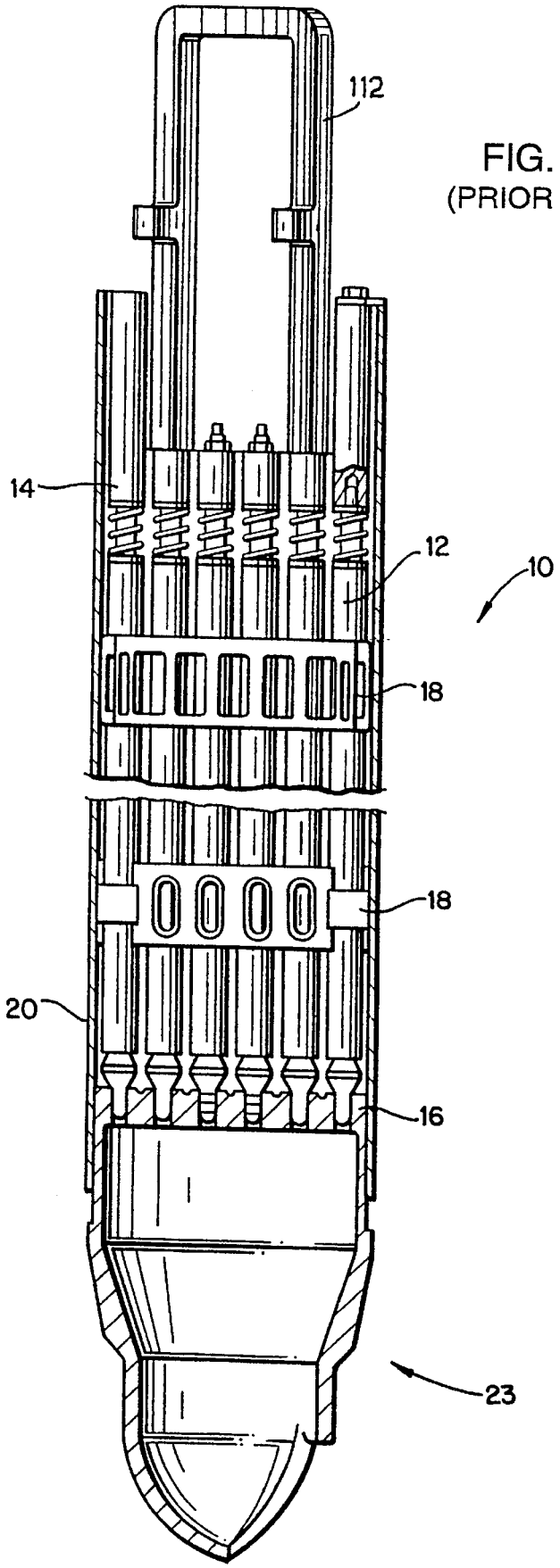
FIG. 1 (PRIOR ART)
FIG. 1 is a side elevation, partly in section, showing a conventional channeled fuel bundle assembly.

With reference to FIG. 1, a conventional fuel bundle assembly 10 comprises generally a plurality of fuel elements or rods 12 supported between an upper tie plate 14 and a lower tie plate 16. The fuel rods 12 pass through a plurality of fuel rod spacers 18 which provide intermediate support to retain the elongated rods 12 in spaced relation, and to restrain them from lateral vibration. These spacers 18 are located at axially spaced positions along the length of the bundle, and in a typical bundle, seven such spacers 18 may be employed. Within the fuel rod bundle 10, certain of the rods about the periphery of the bundle are tie rods rigidly connecting the upper tie plate 14 and lower tie plate 16. In addition, two rods within the interior foursome of each bundle may comprise water rods adapted to introduce moderating material within the bundle interior. One of the water rods also serves as the spacer capture rod which is mechanically locked to each of the seven fuel rod spacers 18. In the conventional assembly shown, the fuel bundle contains 64 rods (including the water rods) spaced and supported in a square, 8×8 array. The fuel bundle 10 as illustrated in FIG. 1 is enclosed within a bundle channel 20 which comprises a substantially square-shaped tubular member extending between the upper tie plate 14 and the lower tie plate 16.

The rods in the bundle may be between 13 and 14 feet in length with a diameter of less than 0.5 inch OD, and a wall thickness of 32 mils. It will be appreciated that these rods must be well protected during shipment and handling prior to use and after use.

Before describing in detail the individual fuel bundle assembly packaging components of this invention, however, a conventional cask and related hardware for shipping fuel rod bundles will be reviewed briefly.

Figure 3:
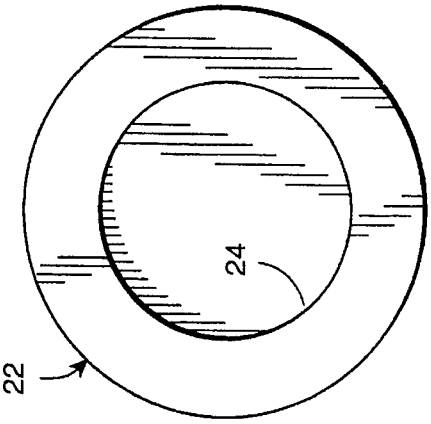
FIG. 3 (PRIOR ART)
FIG. 3 is a left side end view of the cask illustrated in FIG. 2.
Figure 2:
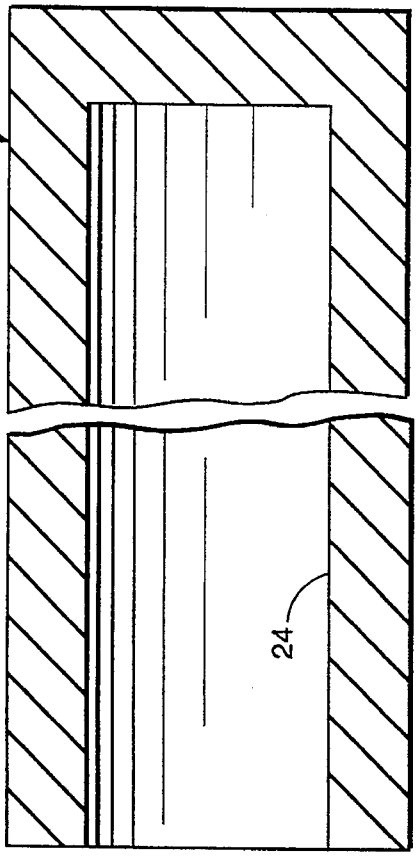
FIG. 2 (PRIOR ART)
FIG. 2 is a simplified partial side section of a conventional cask.

With reference to FIGS. 2 and 3, a conventional outer cask 22 (shown in simplified fashion for ease of understanding) is essentially a hollow cylinder of relatively thick wall construction, with one closed end and one open end adapted to be closed and sealed by an end cap (not shown). The interior volume of the cask is also cylindrical in shape, as defined by the interior wall surface 24. The cask itself forms no part of this invention, and the drawings here illustrate generally only the cylindrical side wall of a commercially available cask, known as the Shoreham IF300 fuel cask assembly. Several fuel bundles, seventeen (17) in the example shown and described here, may be supported within the cask 22, each bundle received within a hollow "basket liner" (described below) which, in turn, is supported in a basket liner frame or holder 23.

Figure 5:
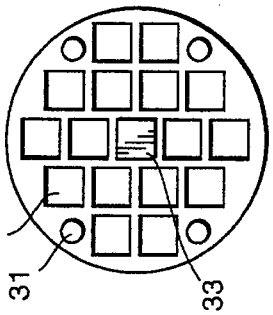
FIG. 5 is an end view of the basket liner assembly shown in FIG.
Figure 4:
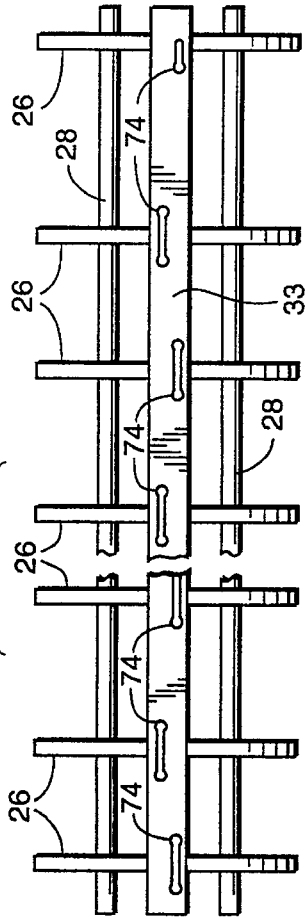
FIG. 4 is a side elevation of a basket liner assembly, simplified for clarity.
Figure 6:
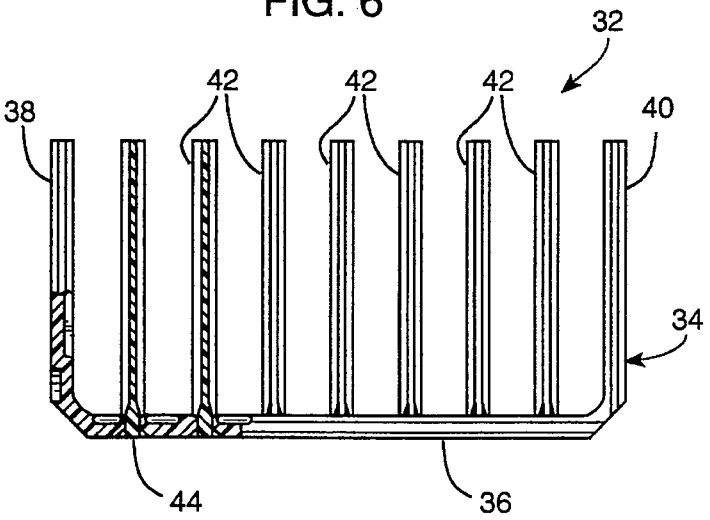
FIG. 6 is a side elevation, partly in section, illustrating a clustered fuel rod separator unit in accordance with this invention.

The basket liner frame or holder 23 for the cask consists of a series of axially spaced disks 26, held together by four tie rods 28 as shown in FIG. 4. The disks 26 are substantially identical, and as best seen in FIG. 5, each disk 26 in this particular assembly is formed with seventeen (17) substantially square openings 30, along with four round openings 31. The latter are designed to receive the tie rods 28 while the former are sized and arranged to receive individual fuel bundle basket liners 33. Each basket liner 33 is an elongated, hollow tube of substantially square cross-section, which is adapted to be received in an aligned group of square openings 30 in disks 26. One such basket liner 33 is shown in place in FIG. 4 and 5, the remaining basket liners having been omitted for the sake of clarity. It will be appreciated that the basket liner holder can hold up to seventeen basket liners, each supported by the nine axially spaced disks 26. Each basket liner 33 is welded preferably at least to the disks 26 at opposite ends of the holder, but may be welded to additional disks 26 as well. The basket liner holder assembly as described above is of conventional construction, with the exception of modifications described herein.

The invention here relates to the manner in which the individual fuel bundle assemblies are packaged and supported within the individual basket liners and within the cask assembly as a whole.

There are essentially five packaging components in accordance with this invention which together provide for enhanced packaging of the fuel bundle assemblies: 1) clustered fuel rod separators; 2) oversize protective channels; 3) basket liner leaf springs; 4) bottom cushioning spacers/springs; and 5) improved top spacers. Each will be described in detail below.

Clustered Fuel Rod Separators

With reference now to FIGS. 6–11, a clustered fuel rod packaging separator unit 32 in accordance with this invention includes an elongated, substantially U-shaped and relatively rigid holder 34 comprised of a base wall 36 and a pair of perpendicularly extending end walls 38 and 40. Within this substantially U-shaped enclosure, a plurality of substantially planar, relatively flexible separator leaves 42 are secured to the base wall 36 and extend in a direction perpendicular to the base wall and substantially parallel to the end walls 38, 40. The separator leaves 42 are spaced within the holder to correspond substantially to the spacing between the fuel rods 12. These leaves 42 are secured to the base wall 36 of the separator holder 34 by means of a plurality of integral leaf anchoring pins 44 which serve to hold the leaves substantially perpendicular to the holder base wall 36 when assembled, despite the relative thin cross-section of the holder.

Figure 8:
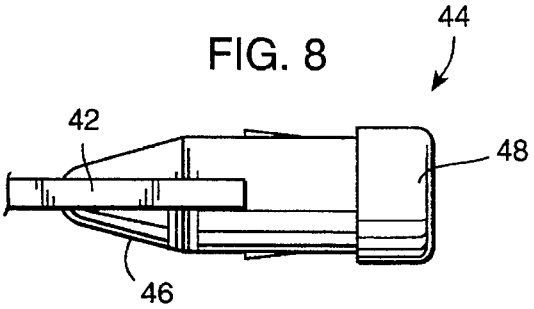
FIG. 8 is a partial side view of a leaf connector in accordance with the invention.
Figure 9:
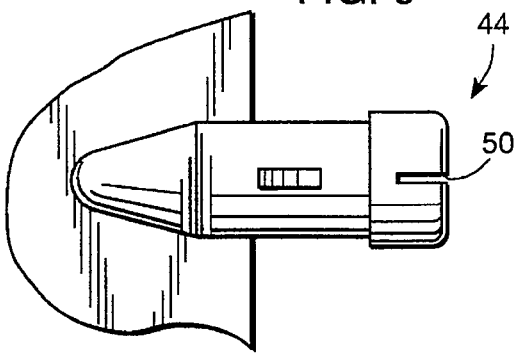
FIG. 9 is a plan view of FIG. 8.

As best seen in FIGS. 8 and 9, each pin 44 is substantially cylindrical in shape, with a tapered end 46 joined to the leaf 42, and an enlarged head 48 projecting beyond the leaf. The head 48 is split by a slot or groove 50 to facilitate insertion into counterbored holes 52 (see FIG. 11) provided in the base wall 36. It will be appreciated that during insertion, the head 46 will compress inwardly and then spring outwardly as it passes into the larger diameter portion of the counterbored holes 52. This arrangement not only insures easy assembly of the separator leaves 42 within the holder 34, but also makes it difficult (but not impossible) to remove the separator leaves 42 from the holder 34.

Figure 10:
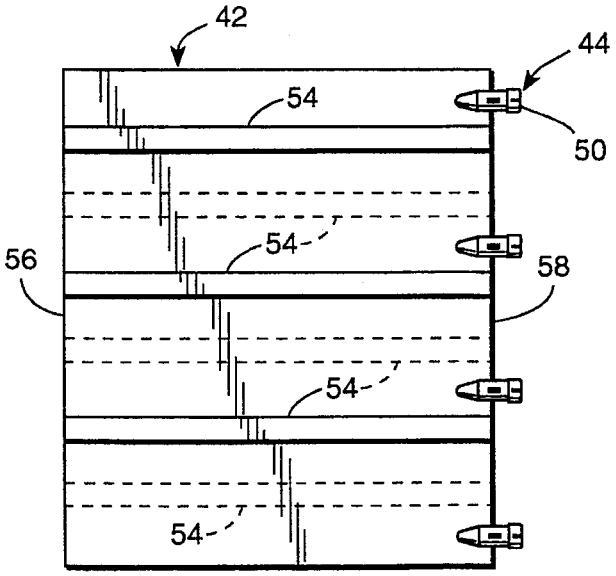
FIG. 10 is a plan view of a planar leaf element taken from the clustered fuel rod separator unit shown in FIG. 6.

With reference specifically to FIG. 10, each leaf 42 is provided with a plurality of ribs or ridges 54 (six in the exemplary embodiment) which extend longitudinally between the edges 56, 58 of the leaf, in substantially parallel relationship with each other. These ridges or ribs 54 project alternately from opposite sides of the separator leaf (as best seen in FIG. 12), and are designed to reduce frictional contact with the fuel rods 12 and thereby also reduce the potential of fretting of the rods from the spacer springs during shipment. Ribs 54 also minimize the forces exerted on the fuel rods by the clustered separator units as a whole. The leaf construction described above provides maximum protection for the fuel rods 12 and also allows for easy insertion and removal relative to the fuel bundle. In the exemplary embodiment shown, the separator unit 32 is designed for use with a 7×7 array of fuel rods. It will be understood, however, that the separator unit (and indeed the invention as a whole) may be configured for use with various fuel bundle configurations.

Figure 7:
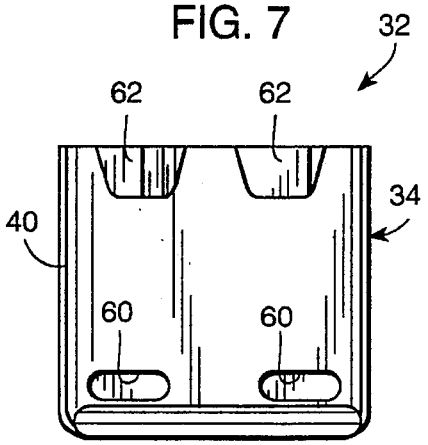
FIG. 7 is an end elevation of FIG. 2.

The end walls 38, 40, of the holder 34 are each provided with a pair of aligned recesses 60 adjacent the base wall 36, as well as a pair of aligned cut-out notches 62 at their free ends remote from the base wall 36, as shown in FIG. 7. Recesses 60 are adapted for engagement with automated and remote installation equipment while notches 62 are designed to facilitate manual insertion and removal of the separator units vis-a-vis the bundle.

The interior or inside surfaces of the holder 34 may be molded to include a waffle pattern of ribs 64 (as on the inside base wall shown in FIG. 11), and/or elongated, parallel ribs 66 (as on the inside surfaces of the respective end portions also shown in FIG. 11). This insures a relatively rigid holder which will maintain the overall shape of the unit in use.

Figure 13:
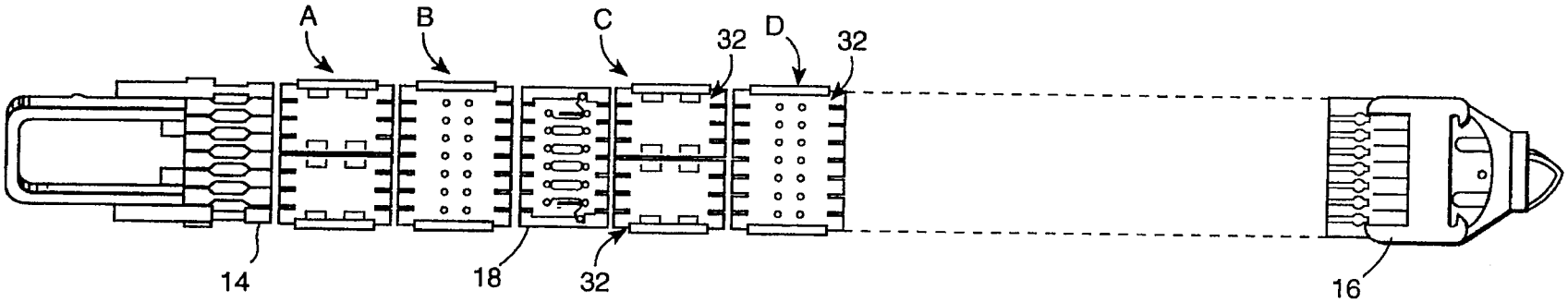
FIG. 13 is a partial side view of a fuel bundle assembly, broken at several locations to reduce overall length, illustrating multiple pairs of clustered fuel rod separator units installed between conventional fuel rod spacers.

Turning now to FIG. 13, a pair of clustered separator units 32 are shown at "A", inserted between the fuel rods from opposite sides until the ends 36, 38 approximately abut each other. An adjacent pair of clustered separator units 32 are inserted at "B" between the fuel bundle rods, but rotated 90° from the first set of separator units. By so alternating adjacent pairs of the separator units, (as shown at C, D, etc.) support and protection are provided to the fuel rods in both vertical and horizontal modes of oscillations. In the exemplary embodiment, four pair of alternately rotated clustered separator units 32 may be installed between each adjacent pair of spacers 18. Thus, in an exemplary embodiment where seven spacers 18 are employed along the length of the fuel bundle, sixty-four (64) such separator units 32 will be utilized to protect the fuel rods during shipment.

The entire clustered separator unit 32 may be constructed of low-density polyethylene or other suitable plastic or metal material.

It is also contemplated that the separator material be impregnated with (or otherwise contain) neutron absorbing or moderating materials, or materials which can attenuate the gamma or neutron radiation, i.e., a neutron poison such as boron compounds, alloys or mixtures. By incorporating a neutron poison in the separator material, criticality control is enhanced and thus, cask capacity and overall system efficiency can be significantly improved. Traditionally, the spent fuel shipping cask is the component that contains the neutron poison for criticality control purposes. However, it has now been recognized that for some fuel, the neutron poison may be separate from the cask or canister. In other words, the poison may be incorporated into the fuel rod matrix so as to further reduce the overall reactivity of the bundle. As a result, spacing between bundles can be reduced, thereby enabling more bundles to be packed into a single given size cask. Alternatively, larger casks with greater numbers of bundles can be utilized in light of the reduction in reactivity afforded by the use of poison impregnated separators. In addition, when the bundles have finally reached their place of storage, the fuel bundle assemblies can be stored closer together, thereby resulting in even further efficiency.

Oversize Protective Channel

Figure 14:
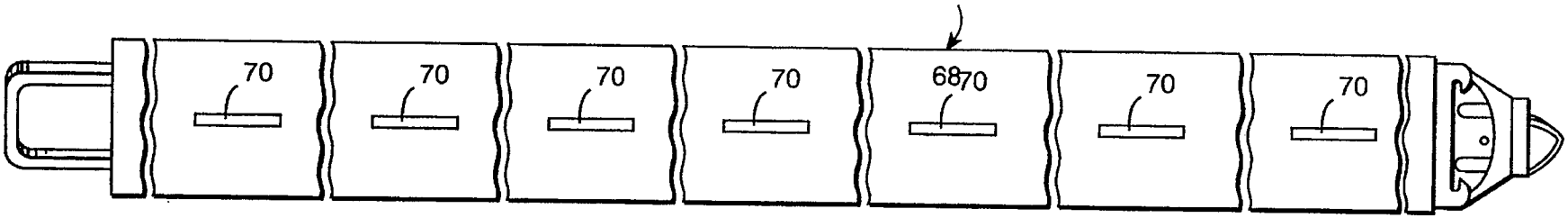
FIG. 14 is a side view of the fuel assembly shown in FIG. 13, inserted with an oversized protective fuel channel.
Figure 15:
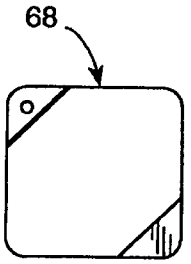
FIG. 15 is a left side end view of the oversized channel shown in FIG. 14, but with the fuel assembly removed.

With reference to FIGS. 13, 14 and 15, the fuel bundle assembly with its clustered fuel rod separators 32 installed as shown in FIG. 13, is inserted into a square section, oversized protective channel 68 (FIG. 14) which holds the clustered fuel rod separators 32 in place, and provides additional rigidity and protection to the fuel bundle. This protective channel 68, if installed over irradiated fuel, is designed to replace the existing channel 20, and uses similar hardware to fit the existing upper and lower tie plates 14, 16, respectively.

For new fuel, the oversized channel 68 replaces the separate shipping channel now usually employed in the shipment of fuel bundles (the bundle channel 20 is typically shipped in a separate container).

It will be appreciated, however, that if the clustered fuel rod separators 32 were made thin enough so as to allow the bundle channel 20 to slide over the bundle, then the oversized channel 68 would not be needed. For purposes of discussion here, however, it will be assumed that the oversized channel 68 is part of the packaging system.

The oversized channel 68 optionally may be provided with a series of axially spaced slots 70 which permit visual inspection of the bundles, and particularly the clustered fuel rod separators 32, so that their proper location and alignment of the latter relative to the bundle can be confirmed.

Basket liner Leaf Springs

Figure 18:
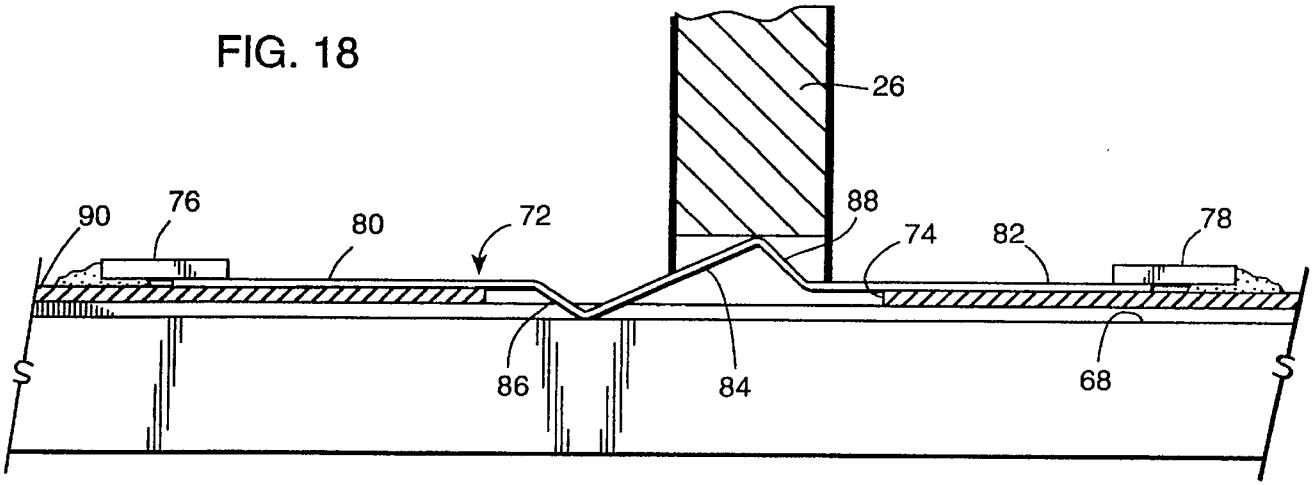
FIG. 18 is a side section, illustrating the leaf spring of FIG. 16 mounted in place on a basket liner member in accordance with this invention, between an oversized protective channel and a basket liner assembly disk.
Figure 19:
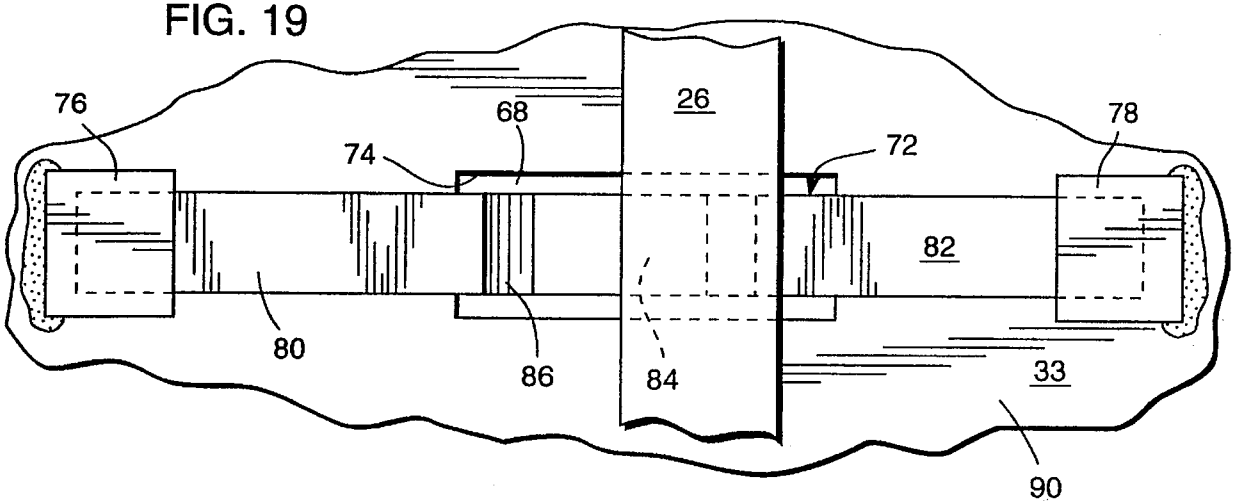
FIG. 19 is a plan view of the arrangement shown in FIG. 18.

Individual leaf springs 72 in accordance with this invention are utilized to hold the channeled fuel bundle (with the standard or oversized channel) firmly against a wall of the basket liner 33 in which the channeled bundle is inserted. To this end, elongated slots 74 are formed in the basket liner, as best seen in FIGS. 4, 18 and 19. These slots 74 are shown in one side wall surface of the basket liner 33, running parallel to the axis of the basket liner but offset from one another. In the preferred arrangement, the slots 74 are located only on one horizontal side surface of the basket liner, one slot 74 for each disk 26. It will be appreciated however, that the number and placement of slots (and associated leaf springs) may vary depending on weight and specific configuration of the bundle. Each slot 74 is bordered by clips 76, 78 welded to the basket liner 33 adjacent axial ends of the slots. Each pair of clips 76, 78 is designed to hold a single leaf spring, as described below, centered relative to respective slot 74.

With reference now to FIGS. 16 and 17, a leaf spring 72 is illustrated which includes an elongated metal strip (preferably made of Inconel) and appropriately hardened or otherwise heat treated. The metal strip is formed to include a pair of co-planar end portions 80, 82 connected by angled center portion 84. The latter is connected to the end portions 80, 82 by similarly angled (i.e., substantially parallel) connecting portions 86, 88. To insure proper orientation, one side of the spring may be labelled "This Side Up" (or similar message).

In use, each spring 72 is located such that end portions 80, 82 are held in the pair of clips 76, 78, respectively, with the angled centered portion 84 passing through the associated slot 74, as best seen in FIGS. 18 and 19. It will be seen that the oppositely facing surfaces along which the angled center portion 84 meets the connecting portions 86, 88 bear on the adjacent disk 26 outside the basket liner, and the oversized channel 68 inside the basket liner, as best seen in FIG. 17. As indicated above, these springs are located along one side surface 90 of the basket liner 33, recognizing that the cask 22 is oriented horizontally when shipped. Thus, the individual fuel bundles, lying horizontally within the cask/basket liner assembly, are biased towards the opposite, interior side surface of the basket liner by leaf springs 72. It will also be appreciated that, during insertion of the bundles into the basket liner, the springs 72 will flex sufficiently to allow complete axial insertion.

The arrangement and number of leaf springs 72 is not limited by the arrangement described above, and may vary in accordance with particular applications of the invention.

The Bottom Spring

Figure 20:
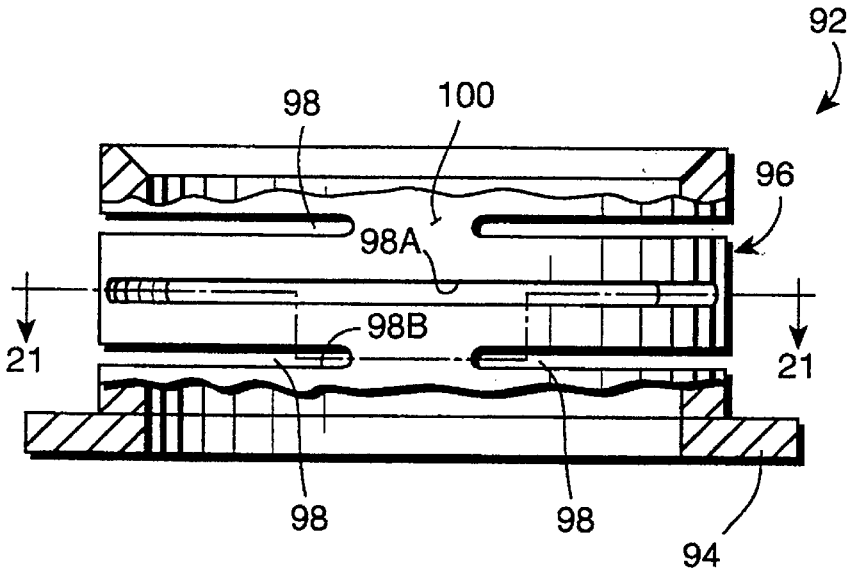
FIG. 20 is a side elevation, partly in section, illustrating a spring spacer for placement in a basket liner in accordance with the invention.
Figure 21:
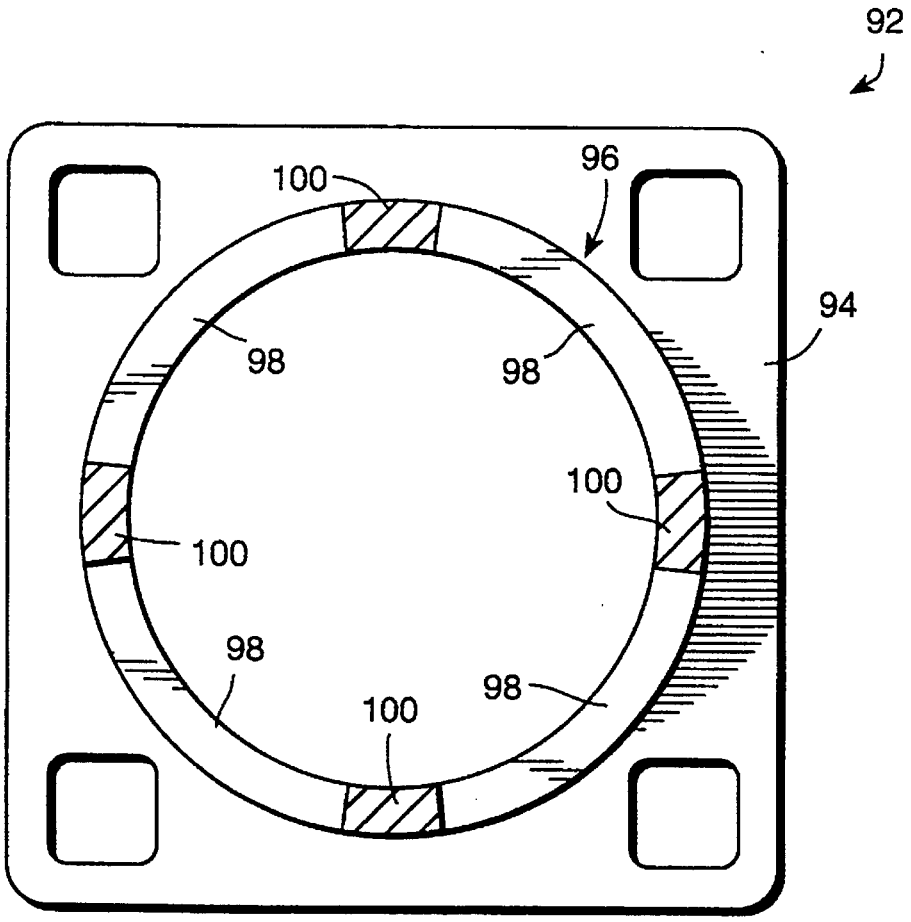
FIG. 21 is a plan view of FIG. 20.

With reference now to FIGS. 20 and 21, a bottom spring 92 is designed to be placed at the bottom of the basket liner, i.e., between the lower tie plate and nozzle of the fuel bundle and the closed end of the cask. The spring 92 includes a flat base 94 and a substantially cylindrical spring body 96 provided with peripheral slots 98 through the full thickness of the body 96. Four slots are formed at a given axial location, connected by webs 100.

In the illustrated embodiment, three groups of slots 98, 98A and 98B are formed at three axial positions along the body 96. The upper and lower groups of slots 98 and 98B (as viewed in FIG. 20) are substantially vertically aligned whereas the intermediate group of slots 98A are offset by substantially 90°. This arrangement allows the cylindrical body 96 to resiliently compress and expand in the nature of a spring.

In use, a spring 92 is placed in the bottom of each basket liner 33, before insertion of the respective fuel bundle. The spring cushions the bundle when it is in an upright position (i.e., under the weight of the bundle), and minimizes undesirable accelerations and loads on the bundle during shipment.

The Top Plate Spacer

Figure 22:
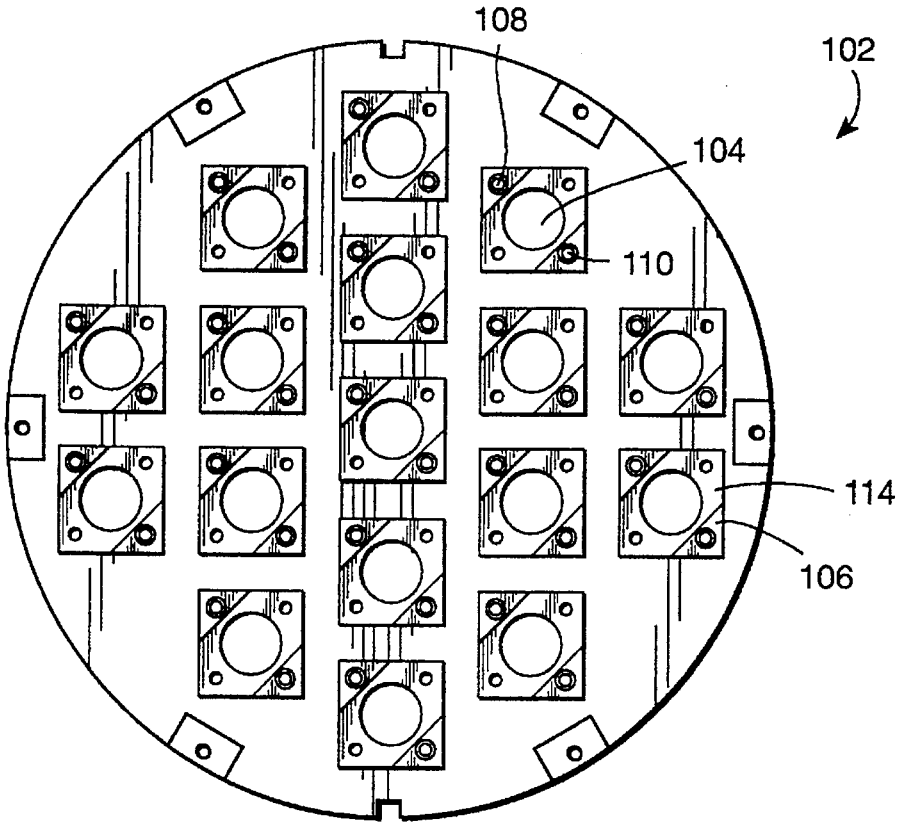
FIG. 22 is an end view of a spacer plate in accordance with the invention.
Figure 23:
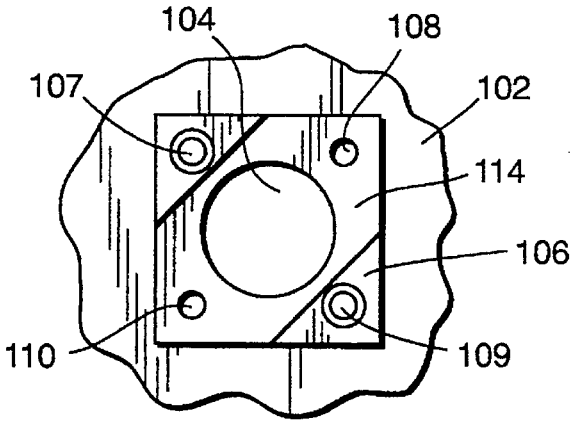
FIG. 23 is an enlarged detail taken from FIG. 22.

In the current cask construction, a spacer disk 102 is located between the cask assembly top plate or end disk 26- and the cask end (not shown). This spacer disk 102, as shown in FIG. 22 is essentially a round disk with a plurality of openings 104 corresponding in number and location with the seventeen basket liners 33 in the basket liner assembly. Over each opening 104 there is bolted a square spacer plate 106, fixed at opposite diagonal ends by suitable fasteners 108, 110 to the surface of the plate 102 which faces the cask interior, i.e., the basket liner assembly. These metal spacer plates 106 are axially aligned with each basket liner and serve to reduce the axial clearance between the upper end of the fuel bundle assembly (and particularly the handle 112 on the upper tie plate) and the spacer plate. In order to prevent metal-to-metal rubbing action between the handles 112 and the spacer plates 106, there are provided additional spacer plates 114 constructed (preferably) of polyethylene (or other suitable material) and applied over the existing spacer plates 106. The plastic spacer plates 114 are secured via bolts or screws (countersunk) 107, 109 to the existing plates as shown in FIGS. 20 and 21. The plastic spacers, which may be ¼ to ⅜ inch thick, serve to further reduce axial clearance, thus further minimizing the axial distance the fuel bundle assembly can slide or drop during handling and shipping. This, in turn, minimizes undesirable acceleration and loads on the fuel bundle.

From the above description, it will be appreciated that the above described components, both individually and collectively, improve the existing cask assembly by providing increased protection for nuclear fuel bundles during shipment. It should also be noted that all of the above components can be installed remotely with automated machines, and can be installed and/or removed underwater where required.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a nuclear reactor fuel bundle packaging apparatus including a hollow cylindrical cask and a basket liner assembly receivable within the cask, the basket liner assembly including a plurality of laterally spaced disks rigidly held by a plurality of tie rods, and a plurality of elongated hollow basket liners extending through and fixed to the plurality of disks, each hollow basket liner holding a nuclear fuel bundle assembly having an upper tie plate, a lower tie plate and a plurality of fuel rods arranged in a substantially square array, extending between said upper and lower tie plates, the improvement comprising an oversized hollow fuel bundle channel received over the fuel bundle assembly, said channel having the same cross sectional shape as said basket liner but sized to fit within said basket liner member, said basket liner having at least one slot formed in at least one side thereof at each disk, and at least one spring mounted on said basket liner spanning said slot with one surface of said spring engaging the disk and another surface of said spring engaging an adjacent surface of said oversized hollow fuel bundle channel.

2. The improvement of claim 1 wherein all of said slots are located on said at least one side of said basket liner such that all of said springs bias the oversized fuel bundle channel and fuel bundle assembly therein in one direction within the basket liner.

3. The improvement of claim 1 and further including a resilient bottom spacer located within each basket liner, between the lower tie plate of the fuel bundle assembly and a lower end of the basket liner.

4. The improvement of claim 1 and further including spacers located between the upper tie plate and an upper end of the cask, the spacers at least partially covered with polyethylene.

5. The improvement of claim 1 and further including a plurality of fuel rod separators inserted within the array of fuel rods.

6. The improvement of claim 5 wherein each separator comprises:

a separator holder having a base wall and a pair of end walls extending in one direction from opposite ends of said base wall;

a plurality of vertically spaced fuel rod separators extending from said base wall in said one direction and substantially parallel to said end walls; and a plurality of recesses provided in exterior surfaces of said end walls adapted for engagement with automated installation equipment.

7. In a nuclear reactor fuel bundle packaging apparatus including a hollow cylindrical cask and a basket liner assembly receivable within the cask, the basket liner assembly including a plurality of laterally spaced disks rigidly held by a plurality of tie rods, and a plurality of elongated hollow basket liners extending through and fixed to the plurality of disks, each hollow basket liner holding a nuclear fuel bundle assembly having an upper tie plate, a lower tie plate and a plurality of fuel rods arranged in a substantially square array, extending between said upper and lower tie plates, the improvement comprising first means for keeping the fuel rods in the array separated from each other; second means for resiliently laterally biasing the fuel bundle assembly within the basket liner; and third and fourth means for preventing substantial axial movement of the fuel bundle within the basket liner, said third and fourth means located at opposite ends, respectively, of the basket liner.

8. The improvement of claim 7 and further including an oversized fuel bundle channel adapted for installation over a respective fuel bundle assembly prior to insertion in a respective basket liner.

9. The improvement of claim 7 wherein said first means comprises:

a separator holder having a base wall and a pair of end walls extending in one direction from opposite ends of said base wall;

a plurality of vertically spaced fuel rod separators extending from said base wall in said one direction and substantially parallel to said end walls; and a plurality of recesses provided in exterior surfaces of said end walls adapted for engagement with automated installation equipment.

10. The improvement of claim 8 wherein said second means comprises a plurality of leaf springs.

11. The improvement of claim 7 wherein said third means includes a resilient bottom spacer adapted for insertion within a respective basket liner prior to insertion of a respective fuel bundle assembly.

12. The improvement of claim 7 wherein said cask includes a spacer disk insertable between the fuel bundle and an end plate of the cask, the spacer disk having a plurality of spacer plates mounted thereon, one for each basket liner, and further wherein said fourth means comprises a plurality of plastic plates overlying respective ones of said spacer plates.

13. The improvement of claim 10 wherein each basket liner has at least one slot formed in at least one side thereof at each disk, and wherein one of said plurality of leaf springs is mounted on said basket liner spanning said slot with one surface of said spring engaging the disk and another surface of said spring engaging an adjacent surface of said oversized channel.

14. In a nuclear reactor fuel bundle packaging apparatus including a hollow cylindrical cask and a basket liner assembly receivable within the cask, the basket liner assembly including a plurality of laterally spaced disks rigidly held by a plurality of tie rods, and a plurality of elongated hollow basket liners extending through and fixed to the plurality of disks, each hollow basket liner holding a nuclear fuel bundle assembly having an upper tie plate, a lower tie plate and a plurality of fuel rods arranged in a substantially square array, extending between said upper and lower tie plates, the improvement comprising means for resiliently holding the fuel bundle assembly within the basket liner, said means capable of exerting resilient biasing forces on the fuel bundle assembly in at least two mutually perpendicular directions.

15. The improvement of claim 14 and further including an oversized fuel bundle channel adapted for installation over a respective fuel bundle assembly prior to insertion in said basket liner.

16. The improvement of claim 15 and further including a plurality of fuel rod separators fitted within the substantially square array.

17. The improvement of claim 15 wherein said means includes a plurality of leaf springs operatively mounted between said oversized fuel bundle channel and said disks.

18. The improvement of claim 17 wherein said means further comprises a resilient bottom spacer adapted for insertion within a respective basket liner prior to insertion of a respective fuel bundle assembly.

19. The improvement of claim 17 wherein each basket liner has at least one slot formed in at least one side thereof at each disk, and wherein one of said plurality of leaf springs is mounted on said basket liner spanning said slot with one surface of said spring engaging the disk and another surface of said spring engaging an adjacent surface of said oversized channel.

20. The improvement of claim 16 wherein each separator comprises a separator holder having a base wall and a pair of end walls extending in one direction from opposite ends of said base wall;

a plurality of vertically spaced fuel rod separators extending from said base wall in said one direction and substantially parallel to said end walls; and a plurality of recesses provided in exterior surfaces of said end walls adapted for engagement with automated installation equipment.

21. The improvement of claim 16 wherein each separator contains neutron posons to improve criticality control.

* * * * *